United States Patent [19]

Marshall et al.

[11] 4,090,674

[45] May 23, 1978

[54] FIXED CUTTING ELEMENT

[75] Inventors: Larry A. Marshall; Alexander Hamilton Murdock, both of Arnprior, Canada

[73] Assignee: Dow Badische Canada Limited, Ottawa, Canada

[21] Appl. No.: 761,106

[22] Filed: Jan. 21, 1977

[51] Int. Cl.[2] ..... B02C 18/44

[52] U.S. Cl. ..... 241/221; 83/698; 241/291

[58] Field of Search ..... 241/221–224, 241/242, 291; 83/356.3, 698

[56] References Cited

U.S. PATENT DOCUMENTS

| | | | |
|---|---|---|---|
| 3,214,106 | 10/1965 | Gorman | 241/221 |
| 3,661,332 | 5/1972 | Fritsch | 241/222 |
| 3,779,123 | 12/1973 | Chafee | 83/356.3 X |

FOREIGN PATENT DOCUMENTS

| | | | |
|---|---|---|---|
| 2,454,476 | 11/1976 | Germany | 241/222 |
| 2,137,529 | 3/1973 | Germany | 241/221 |

*Primary Examiner*—Roy Lake
*Assistant Examiner*—Howard N. Goldberg
*Attorney, Agent, or Firm*—George F. Helfrich

[57] ABSTRACT

Disclosed is an improved fixed cutting element for co-operation with a rotary cutting element in an apparatus for comminuting or granulating polymeric and like material. The improved fixed cutting element is a rigid polyhedron of quadrangular cross-section having a top, bottom, front, back and two side faces. Penetrating partially into the polyhedron from the intersection of the top and front faces thereof is a substantially rectangular slot, which extends along the length of the polyhedron from one side face to the other side face thereof. An angle of between about 20° and 70° is formed by the intersection of:

(a) the top face of the polyhedron; and (b) a line perpendicular to the longitudinal cross-sectional axis of the slot and passing through the intersection of the top and front faces of the polyhedron. An insert of very hard material, e.g., of ceramic, conforming to the configuration of the slot, is positioned therein and is adhesively bonded to all surfaces thereof. The surfaces of the insert projecting from the slot are ground so that such surfaces are essentially contiguous with the corresponding surfaces of the top and front faces of the polyhedron.

2 Claims, 3 Drawing Figures

FIXED CUTTING ELEMENT

BACKGROUND OF THE INVENTION

1. Field of the Invention

This invention relates generally to the comminution and granulation of solid material. It relates more particularly to a comminuting or granulating apparatus for polymeric and like material comprising the combination of a rotary cutting element and a cooperating fixed cutting element. More specifically, it relates to such a fixed cutting element which has been modified for increased efficacy.

2. Prior Art

Solid material such as polymeric material is generally transported and sold in comminuted or granulated form. One major advantage therein is that the material in such a form can be readily fed into extrusion and like devices for subsequent forming operations. Moreover, the material in such a form can be easily measured by volume, and can be transported short distances by pressure or suction through conduits.

Of a large number of devices for cutting solid material such as polymeric material into very small pieces, the most satisfactory appear to be those comprising at least one fixed cutting element or bed knife positioned around the cutting circle of a rotary cutting element, which is often provided with plural blades. Examples of such devices are those specified and depicted in the following U.S. Pat. Nos.: 3,661,332; 3,790,093; and 3,897,016. Notwithstanding the efficacy of these and similar devices, they are found wanting in one very significant aspect, viz., the fixed cutting elements or bed knives are usually short lived. That is to say, these bed knives, which are fabricated from construction metals and alloys of all kinds, as well as from very hard materials such as ceramics, must be removed for sharpening or even complete replacement after but a few days of use. Furthermore, the interruptions in operation caused by such sharpenings and replacements result in significant reductions in daily output, which are completely undesirable, especially in view of today's requirements for enhanced speed and improved efficiency in every stage of all manufacturing operations.

SUMMARY OF THE INVENTION

Accordingly, it is the primary object of the present invention to provide an improved fixed cutting element for cooperation with a rotary cutting element in an apparatus for comminuting or granulating polymeric and like material, the improved fixed cutting element having a useful life of from many months to several years, no sharpening thereof being necessary.

This object and other benefits are achieved, and the disadvantages of prior art devices are obviated according to the present invention, by the provision of a fixed cutting element for cooperation with a rotary cutting element in an apparatus for comminuting or granulating polymeric and like material, the fixed cutting element consisting of:

(a) a rigid polyhedron of quadrangular cross-section and having a top, bottom, front, back, and two side faces; the polyhedron having a substantially rectangular slot partially penetrating therein from the intersection of the top and front faces thereof and extending along the length of the polyhedron from one side face to the other side face thereof; an angle of between about 20° and 70° being formed by the intersection of (1) the top face of the polyhedron and (2) a line perpendicular to the longitudinal cross-sectional axis of the slot and passing through the intersection of the top and front faces of the polyhedron; and (b) an insert fabricated from a very hard material such as ceramic or refractory and positioned within the slot and conforming to the configuration thereof, the insert being adhesively bonded to all surfaces of the slot, the surfaces of the insert projecting from the slot being ground so that such surfaces are essentially contiguous with the corresponding surfaces of the top and front faces of the polyhedron.

It has been found of especial advantage if in the present invention the angle formed by the intersection of (1 ) the top fce of the polyhedron and (2) a line perpendicular to the longitudinal cross-sectional axis of the slot and passing through the interesection of the top and front faces of the polyhedron is between about 40° and 50°, most advantageously 45°.

BRIEF DESCRIPTION OF THE DRAWINGS

For a more complete understanding of the present invention, including its primary object and benefits, reference should be made to the Detailed Description of the Preferred Embodiments, which is set forth below. Such Detailed Description should be read together with the attached Drawings, wherein.

DETAILED DESCRIPTION OF THE PREFERRED EMBODIMENTS

Figure 1:
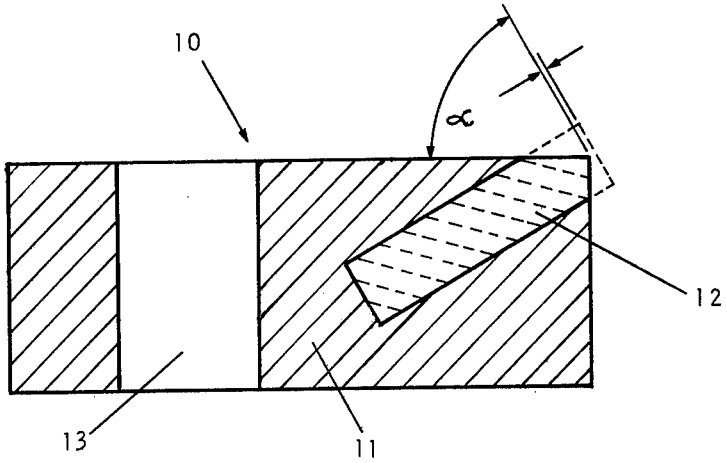
FIG. 1 is a sectional view schematically illustrating an improved fixed cutting element according to the present invention.
Figure 2:
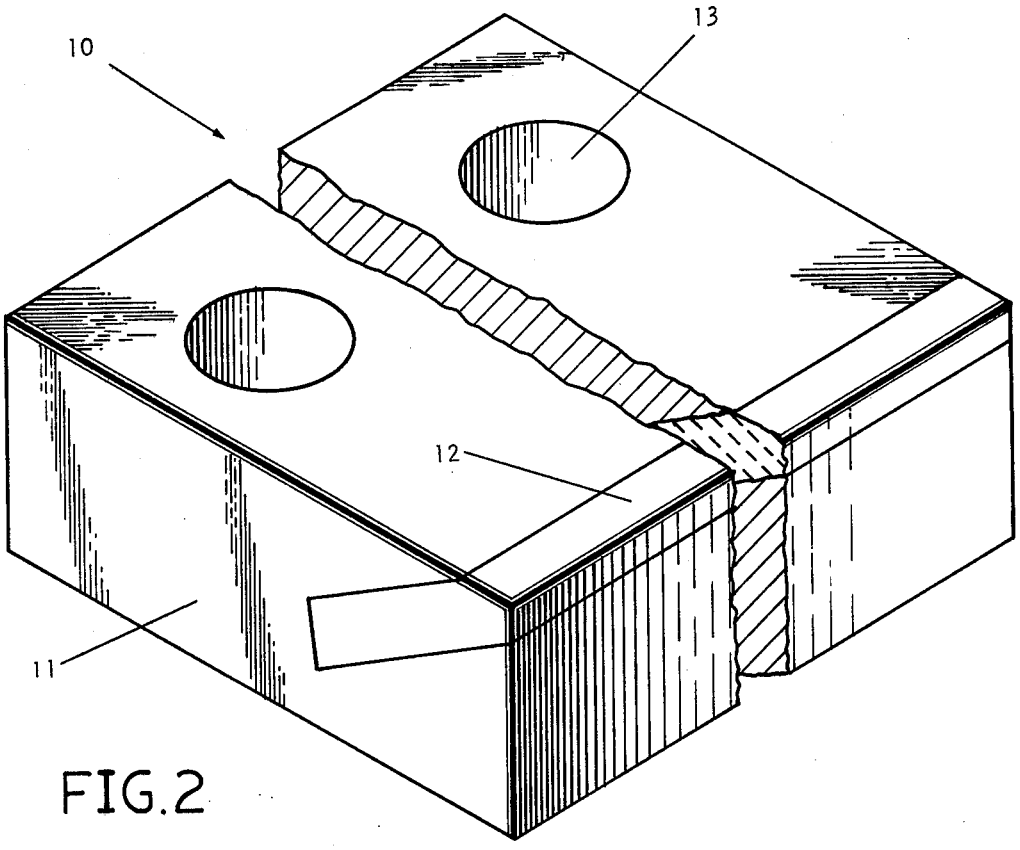
FIG. 2 is a perspective view schematically illustrating the same improved fixed cutting element shown in section in FIG. 1.

With particular reference to the drawings, there is shown in FIGS. 1 and 2 an improved fixed cutting element 10 according to the present invention. Fixed cutting element 10 consists of polyhedron 11, having a top, bottom, front, back, and two side faces. Polyhedron 11 is quadrangular in cross-section, rectangular being shown in the embodiment depicted. Of course, other quadrangular cross-sectional configurations are useful, such as the square. Polyhedron 11 is fabricated from a rigid material of construction selected from commonly employed tool metals and alloys, such as hard tool stainless steel. To facilitate the positioning and securing of fixed cutting element 10 in proximity to the rotary cutting element with which it cooperates, a hole 13 is drilled through the body of polyhedron 11 from top to bottom in proximity to each side face thereof, and bolts (not shown) are inserted through each of the holes 13.

Partially penetrating into polyhedron 11 is a slot (not visible) of substantially rectangular cross-section, which slot is subsequently completely occupied by insert 12 having an identical cross-sectional configuration, as explicated in detail hereinbelow. This slot penetrates into the polyhedron from the intersection of the top and front faces thereof and extends along the length of polyhedron 11 from one side face to the other side face thereof. The exact extent of penetration of the slot into polyhedron 11 is not critical, the degree of ingress varying between wide limits with satisfactory results. Advantageously the distance of penetration of the slot into polyhedron 11 is at least equal to the height of the front face of polyhedron 11.

However, the angle of penetration of the slot into polyhedron 11 is critical. The slot should be positioned so that an angle $\alpha$ of between about 20° and 70° is formed by the intersection of (a) the top face of polyhedron 11 and (b) a line perpendicular to the longitudinal cross-sectional axis of the slot and passing through the intersection of the top and front faces of the polyhedron 11. It has been found to be particularly advantageous if angle $\alpha$ is between about 40° and 50°, especially 45°.

Positioned within the slot and conforming to the configuration thereof is insert 12, which is formed from a hard material such as one of the common ceramic or refractory materials well known and often employed in the art. Such are quite hard substances having a very low coefficient of friction, an example of which is "Henium," which is marketed by the Heany Industrial Ceramics Corporation of New Haven, Connecticut. Before the positioning of insert 12 in the slot, any oil or other surface impurities are removed from the slot and insert 12 by the application thereto of a cleaning solvent such as acetone. This cleaning treatment is followed by evenly applying a thin layer of a standard refractory or ceramic adhesive (such as CTA 11, marketed by the 3M Company of Minneapolis, Minnesota) to the entire surface of both the slot and insert 12, after which insert 12 is inserted into the slot and worked back and forth therein, in order to ensure the removal of any air bubbles and to facilitate uniform coverage and optimum bonding. After a curing at room temperature for a period of at least 24 hours, the surfaces of insert 12 which project from the slot are ground so that they are essentially contiguous with the corresponding surfaces of the top and front faces of polyhedron 11. Fixed cutting element 10 is now ready for positioning to cooperate with a rotary cutting element in an apparatus for comminuting or granulating polymeric and like material, an example of which is now set forth below.

Figure 3:
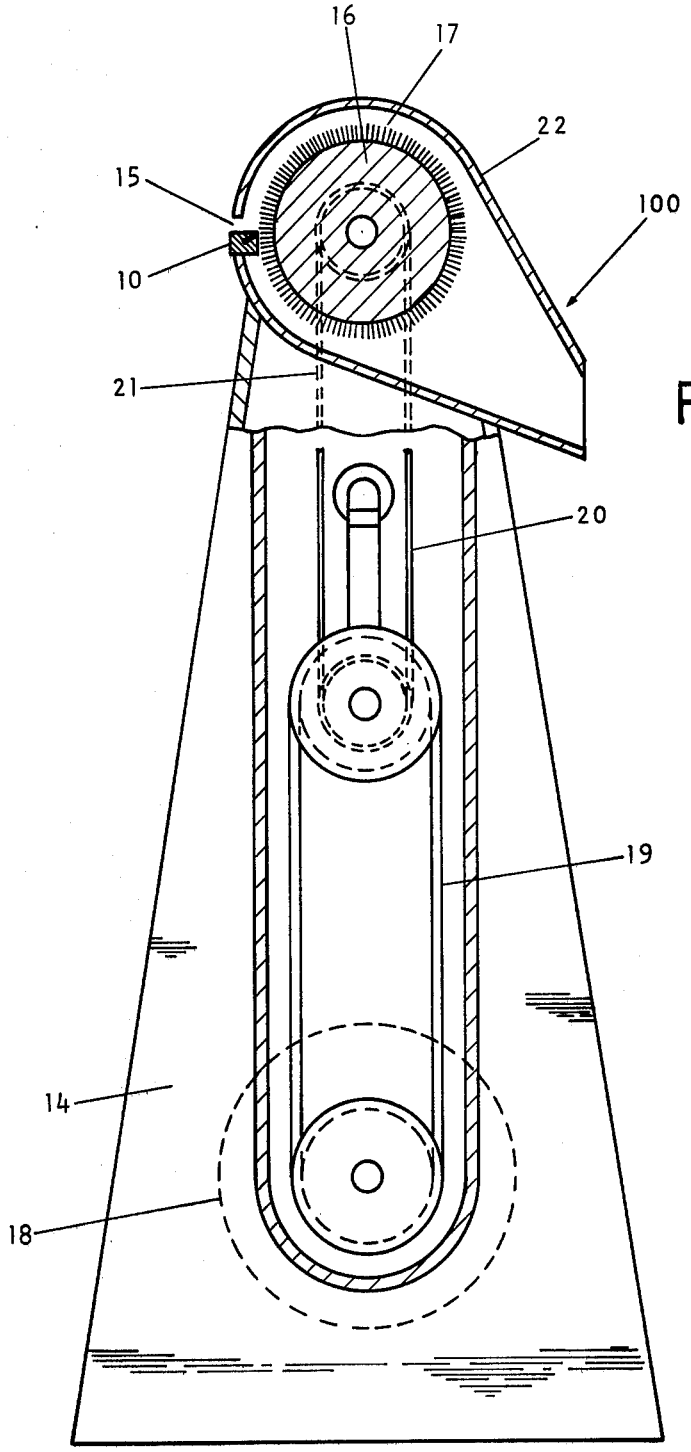
FIG. 3 is a schematic illustration of an apparatus for comminuting or granulating polymeric and like material employing a standard rotary cutting element cooperating with an improved fixed cutting element according to the present invention.

Referring to FIG. 3, there is shown a granulating apparatus 100, which includes a carrier means 14 supporting rotary cutting element 16, which is mounted for rotation thereon in proximity to inlet 15, through which polymeric and like material is fed, preferably in the form of rope-like strands or "spaghetti." A modified fixed cutting element 10 according to the present invention is positioned and securely mounted on carrier means 14 as shown, in proximity to rotary cutting element 16. The free ends of plural blades 17 of rotary cutting element 16 are separated from insert 12 of fixed cutting element 10 by a gap chosen in view of the degree of granulation or comminution desired. The drive means for rotary cutting element 16 includes an electric motor 18, also mounted on carrier means 14, and driving through a pulley belt transmission 19 a shaft which drives rotary cutting element 16 through pulley and belt transmissions 20 and 21. Strands of polymeric or like material, which have been introduced into inlet 15 and have passed through the gap between plural blades 17 of rotating rotary cutting element 16 and the exterior surface of insert 12 of modified fixed cutting element 10 according to the present invention, are sheared into granules or small particles, which are confined in hood 22 and directed thereby into a collection means (not shown) for accumulation and ultimate disposition.

A device essentially identical to that depicted in FIG. 3 and described immediately above has been operated for over 28 months with no down time necessitated by either sharpening or replacement of the improved fixed cutting element 10 according to the present invention.

Although the present invention has been described in detail with respect to certain preferred embodiments thereof, it is apparent to those of skill in the art that variations and modifications in this detail may be effected without any departure from the spirit and scope of the present invention, as defined in the hereto-appended claims.

What is claimed is:

1. In an apparatus for comminuting or granulating polymeric and like material comprising the combination of a rotary cutting element and a cooperating fixed cutting element, the improvement therein which comprises a modified fixed cutting element consisting of (a) a rigid polyhedron of quadrangular cross-section and having a top, bottom, front, back, and two side faces; the polyhedron having a substantially rectangular slot partially penetrating therein from the intersection of the top and front faces thereof and extending along the length of the polyhedron from one side face to the other side face thereof; the top face of the polyhedron and a line perpendicular to the longitudinal cross-sectional axis of the slot and passing through the intersection of the top and front faces of the polyhedron forming an angle of between about 20 and 70 degrees; and (b) an insert fabricated from a ceramic material, the insert positioned within the slot and conforming to the configuration thereof, the insert being adhesively bonded to all surfaces of the slot, the surfaces of the insert projecting from the slot being ground so that such surfaces are essentially contiguous with the corresponding surfaces of the top and front faces of the polyhedron.

2. The improved fixed cutting element of claim 1, wherein the angle formed by the intersection of (a) the top face of the polyhedron and (b) a line perpendicular to the longitudinal cross-sectional axis of the slot and passing through the intersection of the top and front faces of the polyhedron is between about 40° and 50°.

* * * * *